United States Patent [19]

Kawakubo et al.

[11] 3,976,373

[45] Aug. 24, 1976

[54] ELECTROPHOTOGRAPHIC COPYING APPARATUS WITH RECIPROCATING RECORDING MEDIUM CARRIER

[75] Inventors: Kazuo Kawakubo, Hino; Isao Takahashi, Yokohama; Susumu Sugiura, Yamato, all of Japan

[73] Assignee: Canon Kabushiki Kaisha, Tokyo, Japan

[22] Filed: Sept. 10, 1973

[21] Appl. No.: 395,444

[30] Foreign Application Priority Data

Sept. 14, 1972 Japan ..... 47-92342

[52] U.S. Cl. ..... 355/10; 355/3 R; 355/11; 355/72

[51] Int. Cl.[2] ..... G03G 15/22

[58] Field of Search ..... 355/3 R, 4, 6, 10, 11, 355/17, 16, 72, 73, 74, 3 SH; 95/89; 250/477, 481, 468; 354/3, 83, 88, 89, 284

[56] References Cited

UNITED STATES PATENTS

| | | | |
|---|---|---|---|
| 2,892,391 | 6/1959 | Mayo et al. | 355/16 X |
| 3,063,351 | 11/1962 | Medley | 355/3 R |
| 3,091,160 | 5/1963 | Crumrine et al. | 355/14 |
| 3,650,620 | 3/1972 | Hoyt | 355/3 R |
| 3,663,100 | 5/1972 | Itoh et al. | 355/10 X |
| 3,674,362 | 7/1972 | Sadanao Ando | 355/10 |
| 3,687,708 | 8/1972 | Miller | 355/10 X |
| 3,694,069 | 9/1972 | Yamaji et al. | 355/72 X |
| 3,709,593 | 1/1973 | Matsumoto et al. | 355/4 |
| 3,728,023 | 4/1973 | Stevko et al. | 355/3 R X |

*Primary Examiner*—L. T. Hix
*Assistant Examiner*—Kenneth C. Hutchison
*Attorney, Agent, or Firm*—Fitzpatrick, Cella, Harper & Scinto

[57] ABSTRACT

This invention is directed to an electrophotographic copying machine capable of copying small originals such as ID cards. The copying machine includes a recording medium carrier having a cover by which a recording medium is placed within the carrier at a first location before the copying operation is begun and guide rails along which the enclosed recording medium is then driven for the imposition of a uniform charge and a latent image to a second location where the cover is opened and the recording medium is removed and developed while the carrier is returned to the first location.

21 Claims, 17 Drawing Figures

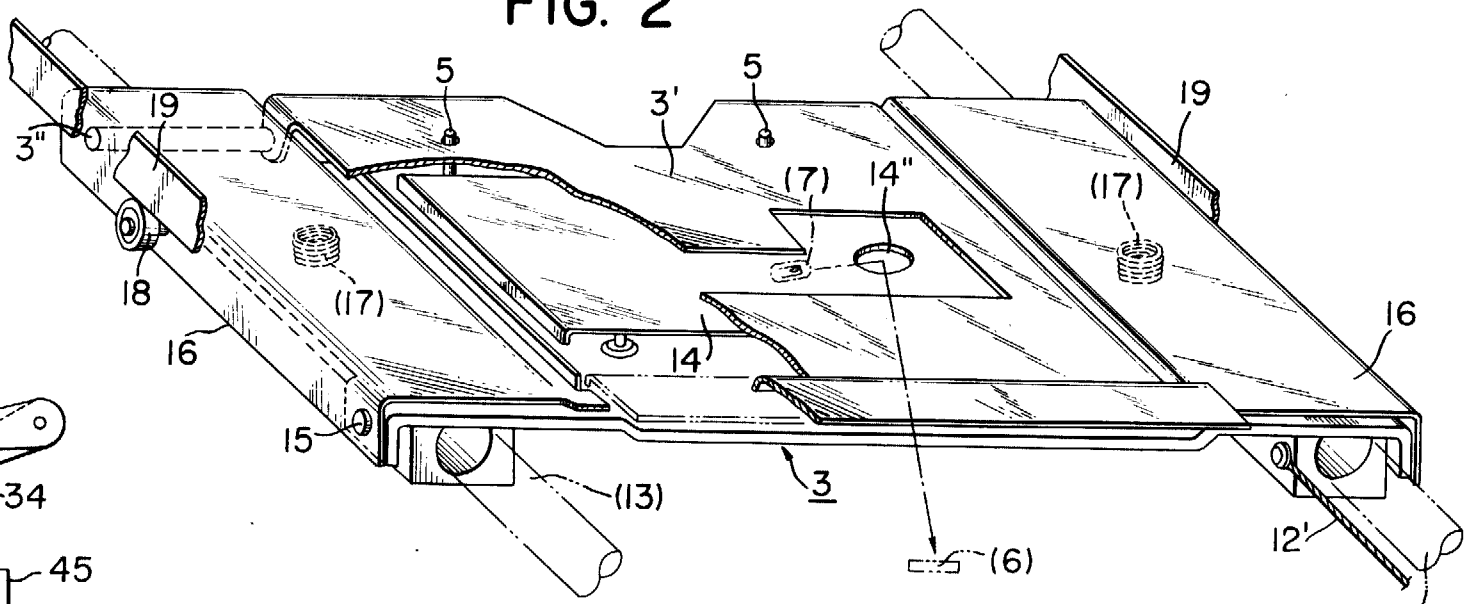
FIG. 2
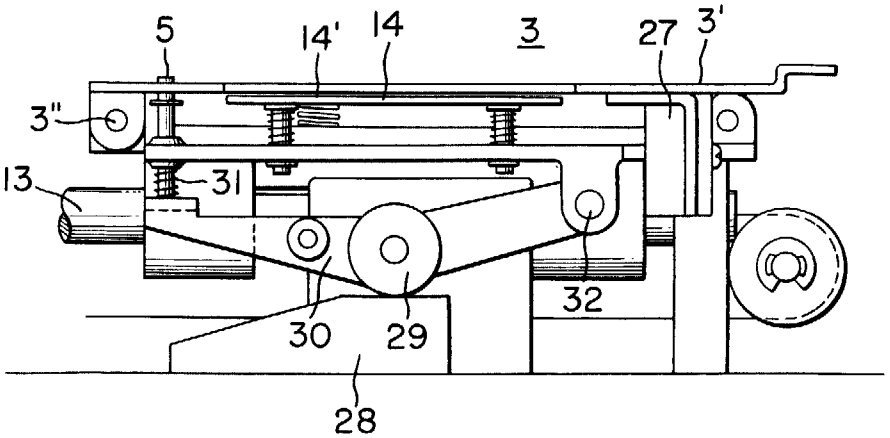
FIG. 3
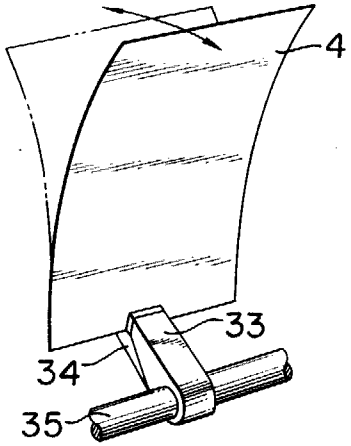
FIG. 6
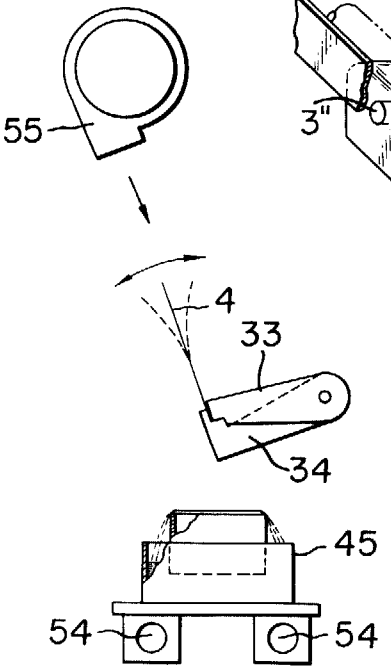
FIG. 5
| | |
|---|---|
| FIG. 12A I | FIG. 12A II |
| FIG. 12B I | FIG. 12B II |
FIG. 12

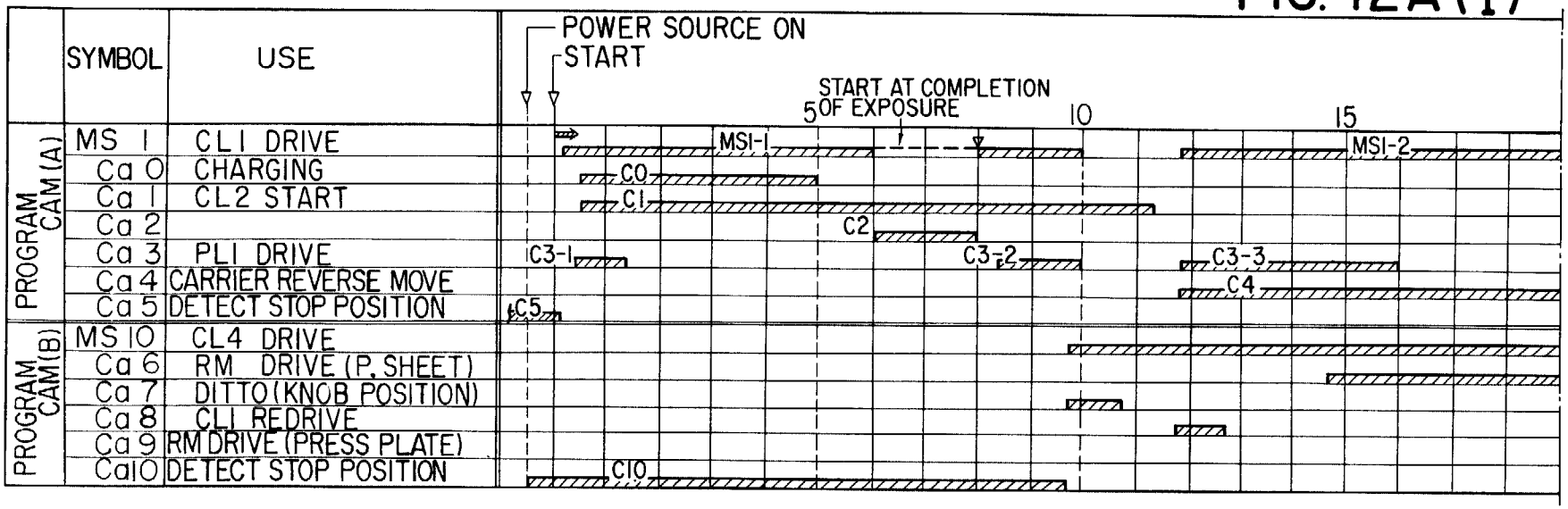
FIG. 12A (I)
POWER SOURCE ON
START
START AT COMPLETION OF EXPOSURE
5
10
15
SYMBOL
USE
PROGRAM CAM (A)
MS 1 CL1 DRIVE
Ca 0 CHARGING
Ca 1 CL2 START
Ca 2
Ca 3 PL1 DRIVE
Ca 4 CARRIER REVERSE MOVE
Ca 5 DETECT STOP POSITION
PROGRAM CAM (B)
MS 10 CL4 DRIVE
Ca 6 RM DRIVE (P. SHEET)
Ca 7 DITTO (KNOB POSITION)
Ca 8 CL1 RE-DRIVE
Ca 9 RM DRIVE (PRESS PLATE)
Ca10 DETECT STOP POSITION
MS1-1
MS1-2
C0
C1
C2
C3-1
C3-2
C3-3
C4
C5
C10
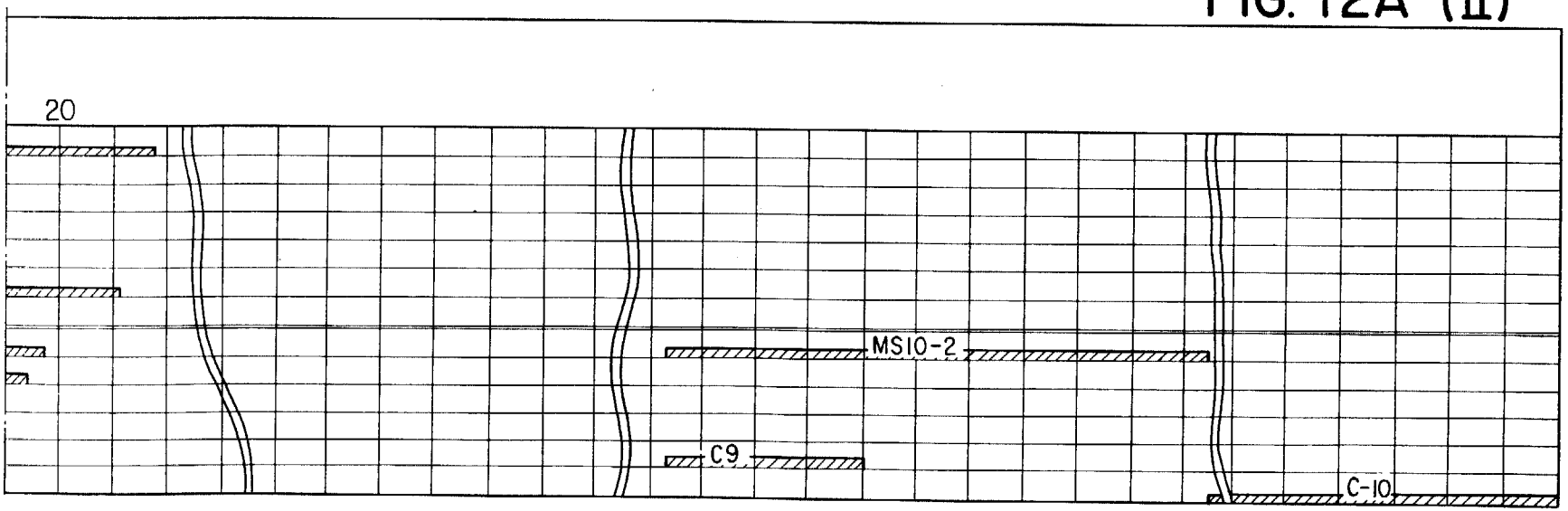
FIG. 12A (II)
20
MS10-2
C9
C-10

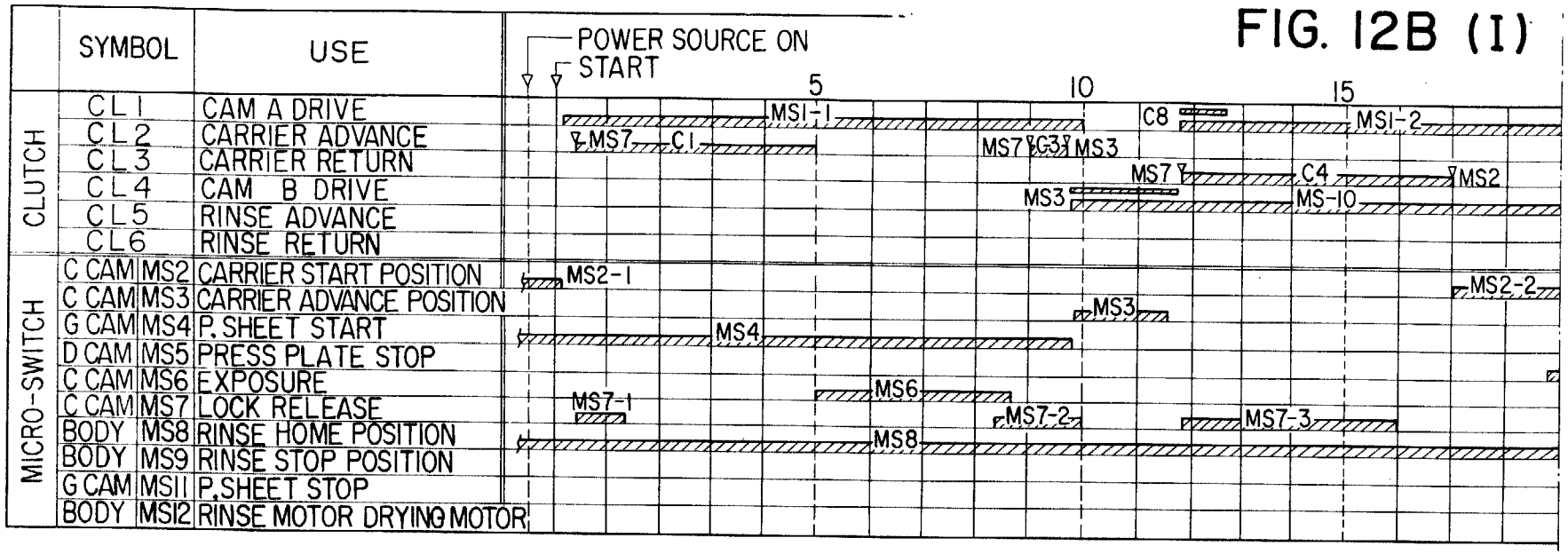
FIG. 12B (I)
SYMBOL
USE
CLUTCH
MICRO-SWITCH
CL 1 CAM A DRIVE
CL 2 CARRIER ADVANCE
CL 3 CARRIER RETURN
CL 4 CAM B DRIVE
CL 5 RINSE ADVANCE
CL 6 RINSE RETURN
C CAM MS2 CARRIER START POSITION
C CAM MS3 CARRIER ADVANCE POSITION
G CAM MS4 P.SHEET START
D CAM MS5 PRESS PLATE STOP
C CAM MS6 EXPOSURE
C CAM MS7 LOCK RELEASE
BODY MS8 RINSE HOME POSITION
BODY MS9 RINSE STOP POSITION
G CAM MS11 P.SHEET STOP
BODY MS12 RINSE MOTOR DRYING MOTOR
POWER SOURCE ON
START
5
10
15
MS7
C1
MS1-1
MS2-1
MS4
MS7-1
MS6
MS8
MS7
MS3
MS3
MS7-2
MS7-3
C8
MS1-2
MS2-2
MS2
C4
MS-10

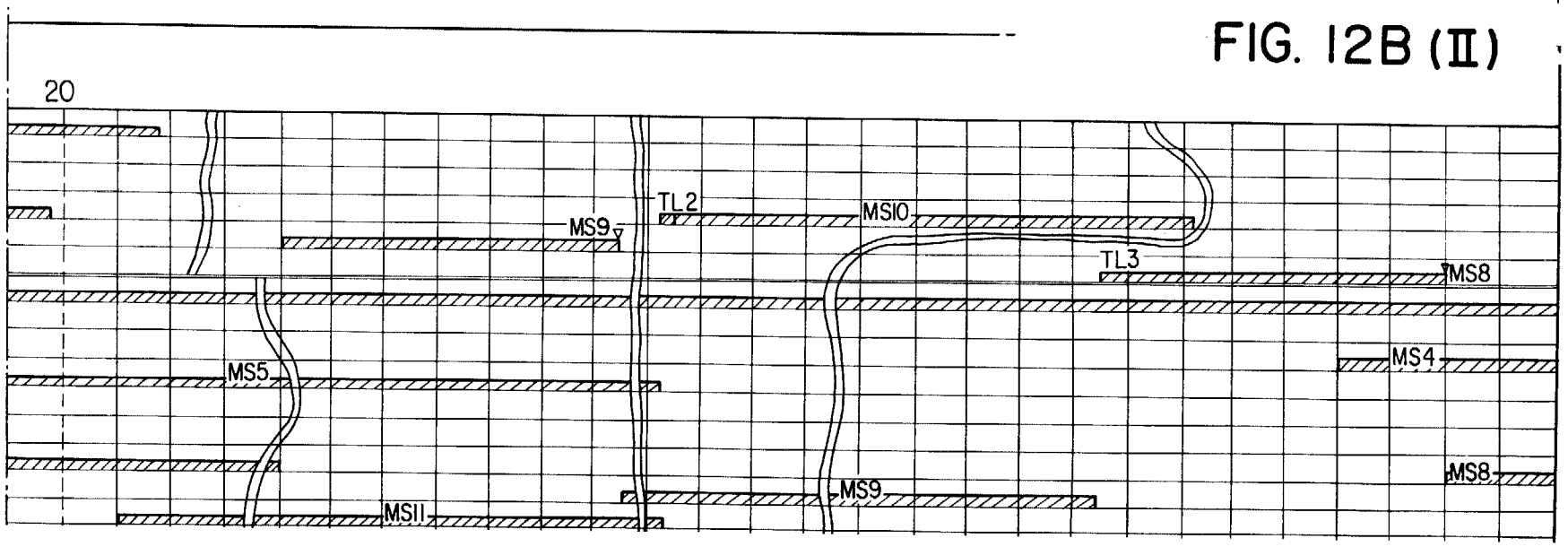
FIG. 12B (II)
20
MS9
TL2
MS10
TL3
MS8
MS5
MS4
MS8
MS9
MS11

ELECTROPHOTOGRAPHIC COPYING APPARATUS WITH RECIPROCATING RECORDING MEDIUM CARRIER

BACKGROUND OF THE INVENTION

1. Field of the Invention

The present invention relates to an electrophotographic copying machine adapted to copy in an efficient manner an original of relatively small size such as an ID card (Identity card), a driver's license, a membership card and so on.

2. Description of the Prior Art

In the conventional ID cards or the like the photos of the possessors are laminated to the cards.

It has been generally difficult for the conventional electrophotographic apparatus to copy an original of very small size.

SUMMARY OF THE INVENTION

One of the objects of the present invention is therefore to provide an electrophotographic copying machine best adapted to copy an original of a relatively small size.

Another object of the present invention is to provide a photocopying machine of the type described and which is simple in construction and compact in size.

A further object of the present invention is to provide a photocopying machine of the type described and which is reliable in operation even after it has been used for a long time.

Still another object of the present invention is to provide a photocopying machine of the type described and capable of copying at a very high speed.

Briefly stated, an electrophotographic copying machine of the present invention generally comprises an original holder means, original illumination means, means for forming an electrostatic latent image of an original upon a precharged recording medium, first transport means for transporting the recording medium through said latent image forming means, developing means for developing the latent image on the recording medium into a visible image, second transport means for transporting the recording means through said developing means, and means for controlling the operations of said original holder means, said latent image forming means, said first and second transport means and, said developing means.

The above and other objects, features and advantages of the present invention will become more apparent from the following description of one preferred embodiment thereof taken in conjunction with the accompanying drawings.

BRIEF DESCRIPTION OF THE DRAWINGS

FIG. 2 is a perspective view of a recording medium carrier;

FIG. 3 is a side view thereof in its initial or start position;

FIGS. 5 and 6 are views used for the explanation of the step of drying a developed recording medium;

FIG. 12 illustrates a time sequence thereof;

DESCRIPTION OF THE PREFERRED EMBODIMENTS

Figure 1:
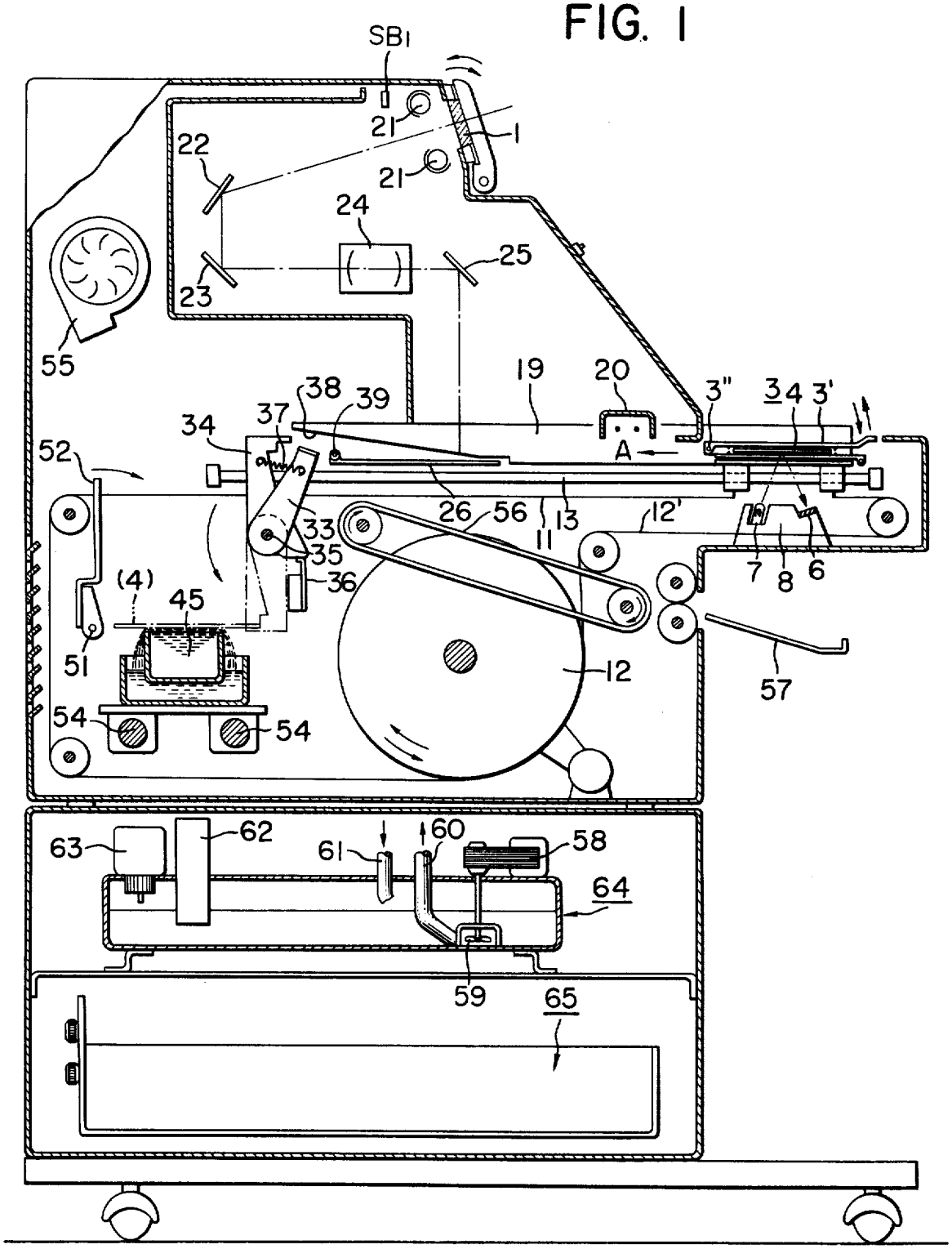
FIG. 1 is a longitudinal sectional view of one preferred embodiment of the present invention.
Figure 7:
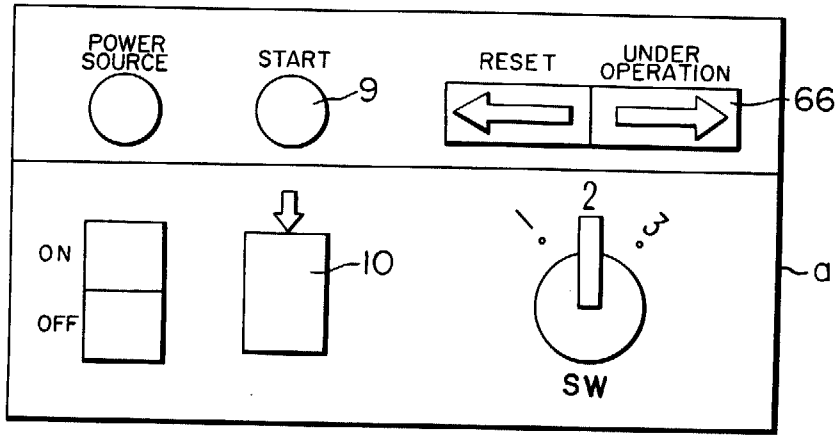
FIG. 7 is a front view of a control panel.
Figure 10:
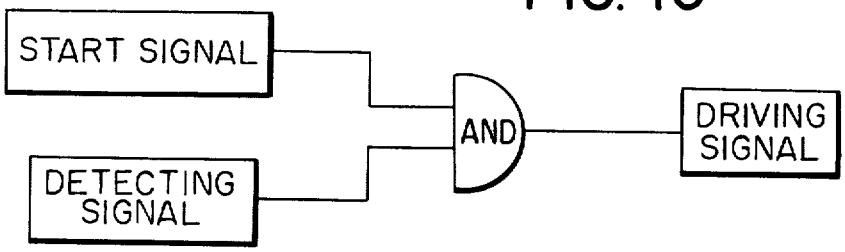
FIG. 10 is a view used for the explanation of the control of the recording medium detecting signal.

Referring to FIG. 1, upon an original holder 1 is placed an original (not shown) such as an ID card, and a cover 3′ of a recording medium carrier 3 which is pivoted at 3″ for opening place therein a recording medium 4 of the substantially same size as that of the original. The set position of the recording medium 4 is controlled by means of positioning pins 5 (See FIG. 2). Below the carrier 3 is disposed a mount 8 upon which are mounted a photocell such as a CdS cell 6 and a lamp 7 in such a way that light emitted from the lamp 7 is reflected by the undersurface of the recording medium 4 back to the CdS cell 6 whereby an indicating lamp 9 on a control panel *a* (See FIG. 7), for indicating that the carrier 3 is ready to start, is turned on. A start switch 10 on the control panel *a* is so interlocked with the indicating lamp 9 that when the latter is turned on the start switch 10 may be turned on (See FIG. 10).

Upon depression of the start switch 10 the carrier 3 is moved from its initial or first position in the direction indicated by A, and an arrow indicating lamp 66 is turned on. The carrier 3 is moved along guide rails 13 by a tension wire 11 moved by the rotation of a drum 12.

As shown in FIG. 2, a pressure plate 14 is disposed below the cover 3′ of the carrier 3, and a pair of intermediate members 16 which together with cover 3′ form a holder for a recording medium are disposed along both side edges of the carrier 3 and are loaded with springs 17 so as to be normally upwardly rotated about shafts 15, but the upward rotation of these members 16 is prevented by means of plate cams 19 in engagement with rollers 18 of the intermediate members 16 while the carrier 3 is advanced. The plate cams 19 also serve as guide means.

Referring back to FIG. 1, when the carrier 3 is advanced below corona discharge means 20 the surface of the recording medium 4 is charged. Thereafter the carrier 3 is stopped in the exposure station where the optical image of the original 2 which is illuminated by a light source such as a halogen lamp 21 is focussed upon the recording medium 4 through mirrors 22 and 23, a lens 24 and a mirror 25 so that the electrostatic latent image is formed. The quantity of light emitted from the source 21 is controlled in a suitable manner by an exposure control system to be described hereinafter.

The carrier 3 is advanced again to the end of the forward stroke, that is, the second position, and stopped. The rollers 18 of the intermediate members 16 of the carrier 3 are released from the undersurface of a point cam plate 26 so that the front side of the intermediate members 16 are opened about the shaft 15 and the carrier cover 3′ is also raised because it is coupled to the intermediate members 16. The rollers 18 are transferred from the undersurfaces of the plate cams 19 to those of the point cam plates 26 as the carrier 3 is advanced.

As shown in FIG. 3 a roller 29 is released from a cam 28 when the carrier 3 is started from its initial or first position so that a lever 30 which is formed integral with the roller 29 is caused to swing downwardly about a pivot pin 32 under the force of a spring 31, thereby causing the positioning pins 5 to move downwardly. As a result the recording medium 4 is released from the positioning pins 5 but is securely held in the correct position by the pressure plate 14.

When the carrier 3 is stopped at the second position a finger 33 which is a recording medium retaining means is rotated about a pin 35 in the counterclockwise direction toward a finger 34 which is held in a predetermined position by a stopper 36, thereby catching the leading edge of the recording medium 4. The finger 34 is loaded with a spring 37 so as to be normally biased toward the finger 33.

As the leading edge of the recording medium 4 is gripped or caught by the pair of fingers 34 and 33 in the manner described above the drum 12 starts to rotate in the opposite direction so that the carrier 3 starts the return stroke. The rollers 18 of the intermediate members 16 are advanced along the inclined surfaces 38 of the plate cams 19. In this case the intermediate members 16 and the carrier cover 3' are not completely closed. When the rollers 18 reach the intersection between the point plates 26 and the plate cams 19, they push the point plates 26 downwardly about a pivot pin 39 and move to the undersurfaces of the plate cams 19 so that the carrier cover 3' and the intermediate members 16 are completely closed. Then the point plates 26 are turned to their initial position under the force of springs. The carrier 3 is returned by a distance longer than the length of the recording medium 4 so that the latent image formed upon the recording medium 4 which is retained by the pair of fingers 33 and 34 which are retaining or gripping means may be prevented from being damaged by the contact with the inner surface of the carrier cover 3'. In the return stroke the carrier 3 is not stopped at the exposure station but is directly returned to the initial or first position. Immediately the carrier 3 is stopped the pins 5 are pushed upwardly by the cam 28 so as to receive the next recording medium. The positioning pins 5 have been retracted in order to permit the return stroke of the carrier 3 while the recording medium 4 is retained by the pair of fingers 33 and 34.

Figure 4:
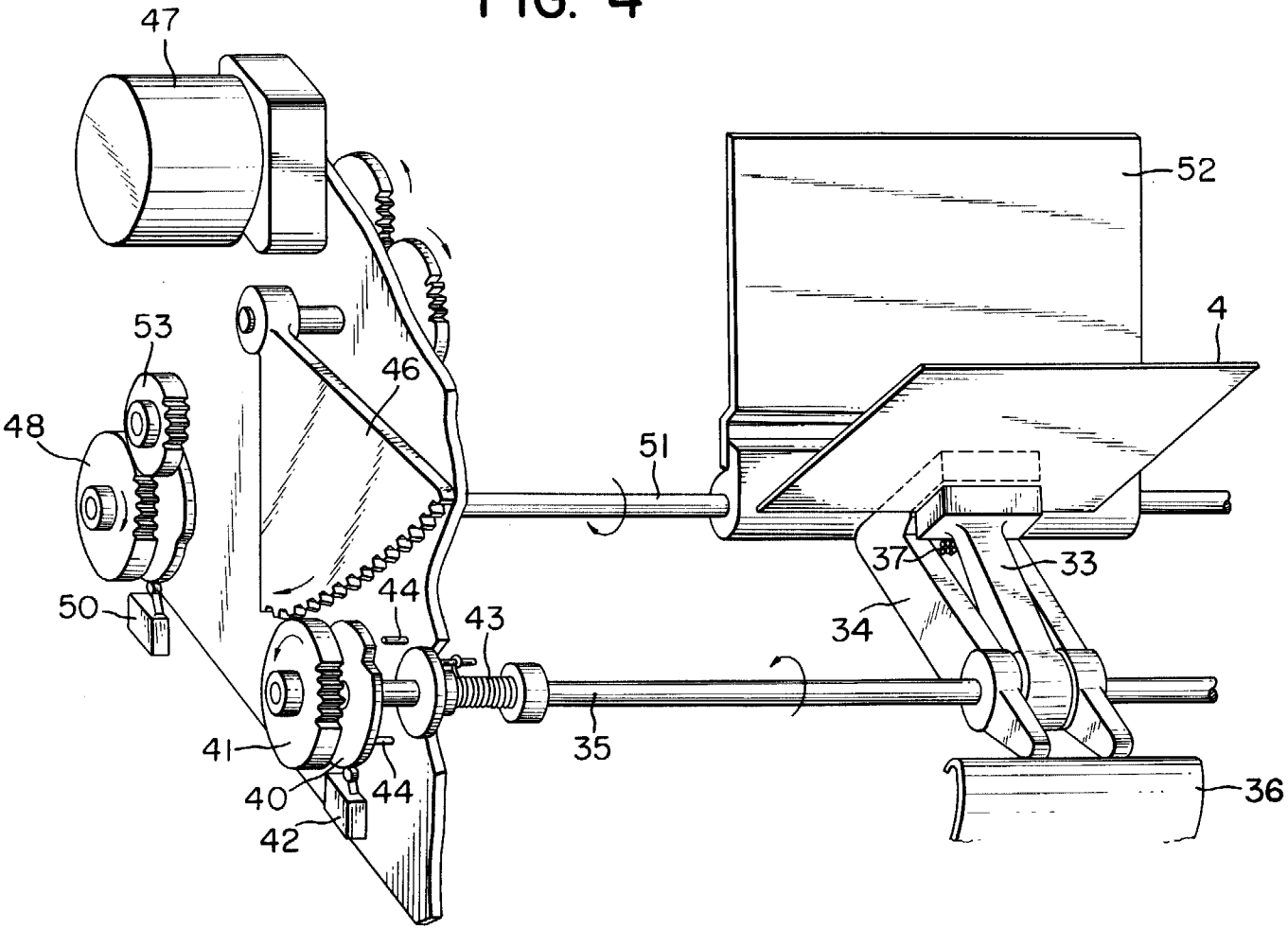
FIG. 4 is a perspective view illustrating a recording medium retaining or gripping means.

When the carrier 3 is returned from the second position toward its initial position by a distance longer than the length of the recording medium retained in position by the pair of fingers 33 and 34, the shaft 35 is further rotated until the recording sheet 4 is brought into contact with the developing liquid in a developing liquid tank or developer 45. As shown in FIG. 4 the rotation of a reversible motor 47 is transmitted to the shaft 35 through a segment gear 46 and a gear 41. Therefore when the gear 41 is disengaged from the segment gear 46 the rotation of the shaft 35 is interrupted. Stoppers 44 are provided in order to determine the position of the gear 41 when it is released from the segment gear 46, and a spring 43 is provided in order to impart some resistance to the rotation of the shaft 35.

The gear 41 is disengaged from the segment gear 46 when the recording medium 4 is brought into contact with the developing liquid in the developer tank 45, and then the segment gear 46 is meshed with an idler gear 53 so that a gear 48 and a cam 49 are rotated to actuate a microswitch 50, thereby de-energizing the reversible motor 47.

As the gear 48 is rotated, a curling preventive plate 52 carried by a shaft 51 carrying the gear 48 is also rotated so as to press the back surface of the recording medium 4 in contact with the developing liquid, thereby preventing the upward movement of the recording medium 4 away from the developing liquid surface under the hydrostatic pressure thereof and also ensuring the uniform contact of the recording medium 4 with the developing liquid. This arrangement is advantageous especially when the thickness of the recording medium is of the order of 100 $\mu$.

Figure 13:
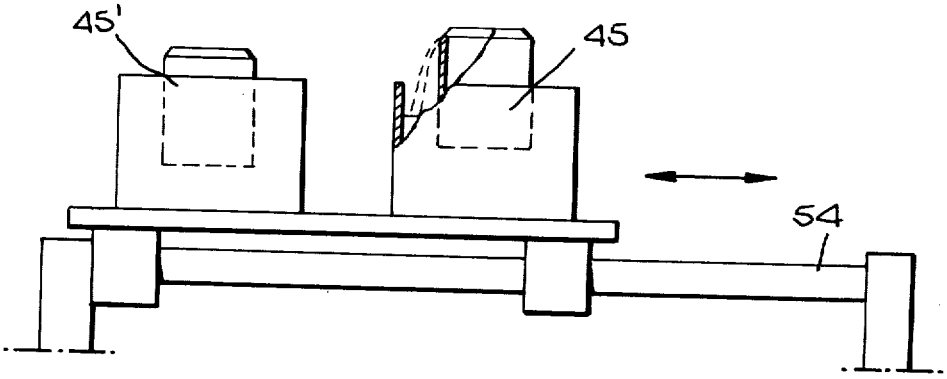
FIG. 13 illustrates the developing and rising tanks and the manner in which they may be moved during the developing process.

After a suitable developing time, the developer tank 45 is displaced along bars 54 away from the recording medium 4 and a tank 45' containing rinsing liquid (which is generally the carrier liquid of the developing liquid) is moved toward the recording medium 4 along bars 54 to rinse the latter. The rinsing liquid tank 45' is similar in construction to the developer tank 45 (see FIG. 13).

After a suitable rinsing time, the reversible motor 47 is rotated in the opposite direction so that the curling preventive plate 52 is returned to its initial vertical position. Thereafter the segment gear 46 meshes with the gear 41 so that the shaft 35 is rotated in the opposite direction. As a result the fingers 33 and 34 are returned to their initial positions while retaining the recording medium 4. During this return stroke, the fingers 33 and 34 are stopped as shown in FIG. 5 so that air from a blower 55 flows substantially in parallel with the surfaces of the recording sheet 4. The recording medium 4 is therefore swung as shown in FIG. 5 and dried.

After a suitable drying time, the segment gear 46 is further rotated so that the finger 34 is stopped by the stopper 36 and the finger 33 is further rotated and stopped. The segment gear 46 is stopped when a microswitch 42 is actuated by a cam 40 so that the reversible motor 47 is stopped. As the finger 33 is moved away from the finger 34, the recording medium 4 is released and dropped upon a conveyor belt 56 (a third position) disposed below the second position of the first transport means or the carrier 3 as the latter is returned to the initial position. Thereafter the recording medium 4 is discharged into a tray 57 by the conveyor belt 56.

The developing liquid is forced into the developer 45 (FIG. 1) through a hose 60 from a developing liquid storage tank 64 as a pump 59 is driven by a motor 58, and the developing liquid overflowing from the developer 45 is returned to the storage tank 64 through a hose 61.

When a decrease in concentration of the developing liquid is detected by a toner concentration detector 62, toner is automatically supplied into the storage tank 64 from a toner tank 63. A rinsing liquid storage tank 65 similar in construction to the developing liquid storage tank 64 is provided, but is not provided with means such as the toner concentration detector 62 and the toner tank 63.

Referring to FIGS. 2 and 3, the pressure plate 14 is loaded with a spring 14' and is provided with an aperture 14'' (through which is transmitted the light emitted from the light source 6 in order to detect whether the recording medium 4 is placed upon the carriage 3 or not).

In the present embodiment, the pair of recording medium retaining fingers 33 and 34 have been described as being rotated in a vertical plane, but it will be understood that they may be rotated in a horizontal plane toward the developing station where the recording medium is developed by a magnet brush developing process. Furthermore the present invention is also useful in a system in which the image developed upon the recording medium is transferred to a recording paper so that the recording medium may be used repetitively, and any suitable process for forming an electrostatic latent image may be employed.

Figure 8:
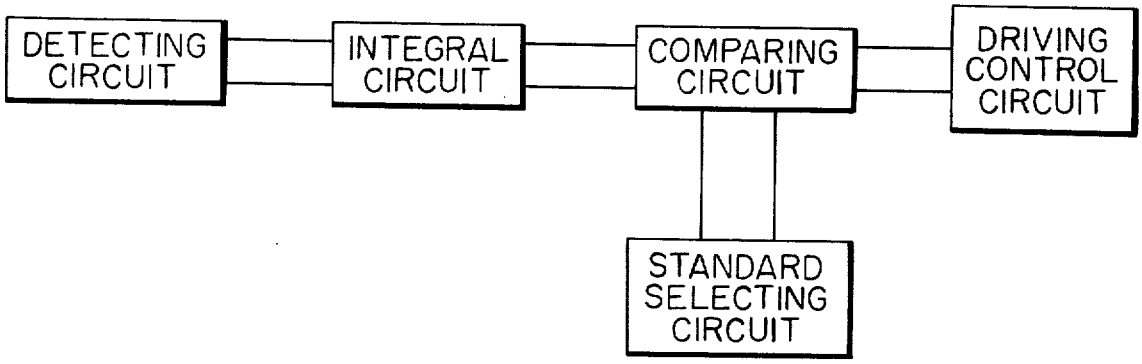
FIG. 8 is a block diagram of an exposure control system.

Next the exposure control system will be described. The quantity of exposure light may be varied by about 30% by an exposure selection switch SW on the control panel shown in FIG. 7. The exposure control system is shown in block diagram in FIG. 8. The output signal of a detecting circuit including light detecting means such as a photosensitive element is intergrated by an integrating circuit, and the output signal of the integrating circuit is compared by a comparator with a reference signal representing the quantity of exposure light set by the exposure selection switch. Therefore when the exposure light reaches a predetermined quantity, the comparator gives a stop signal to a control circuit. Thus the correct exposure may be always ensured regardless of the degradation of aging of the light source.

Figure 9:
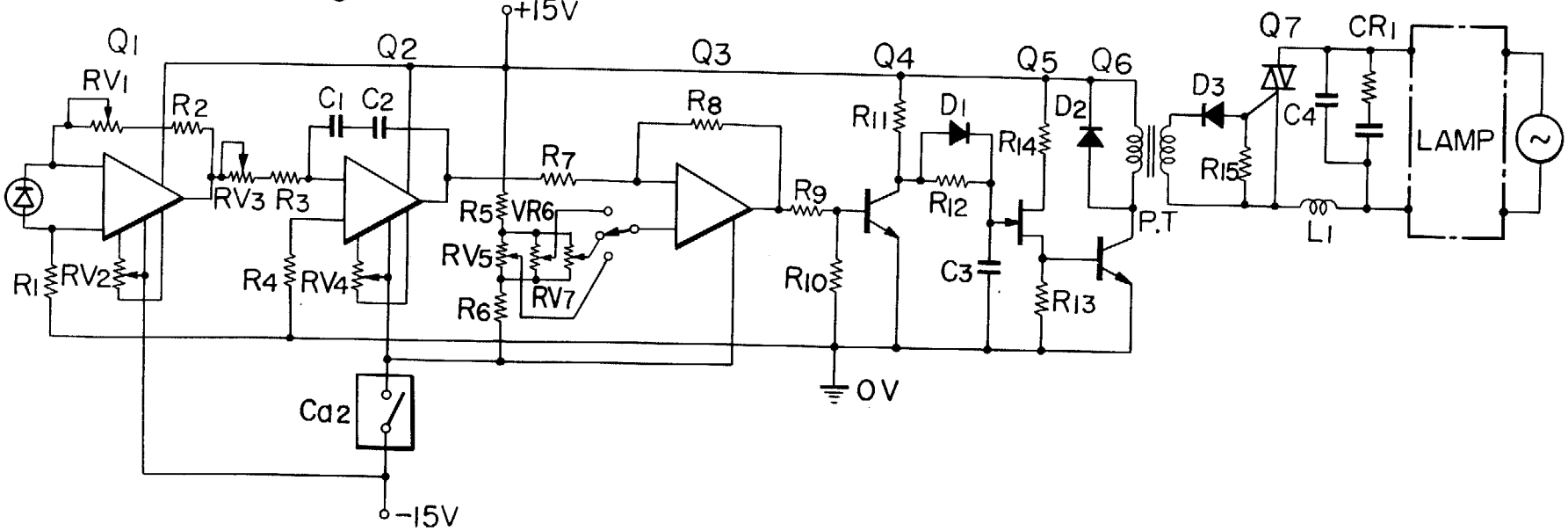
FIG. 9 is a circuit diagram thereof.

Next, referring to FIG. 9 there is illustrated one embodiment of the exposure control system of the present invention, wherein light received from the lamp is converted into electric current by a photosensitive element SB1 such as a solar cell and electric current is converted into voltage by means of an operational amplifier Q1. The values of variable resistors RV1 and RV2 are so selected that the output voltage V1 of the operational amplifier Q1 is almost equal to the power source voltage even when the intensity of light emitted from the lamp is maximum. The output voltage V1 of the operational amplifier Q1 is integrated by an operational amplifier Q2 the operating condition of which is determined by RV3, R3, C1 and C2. The output voltage V2 integrated by the operational amplifier Q2 is compared by an operational amplifier Q3 with one of the reference voltages V5, V6 and V7 which are set by RV5, RV6 and RV7. One of the reference voltages V5, V6 and V7 is applied through a selection switch SW2 to the operational amplifier Q3. When the output voltage V2 of the operational amplifier Q2 coincides with the reference voltage V7, a transistor Q4 is conducted in response to the ouput voltage V3 of the operational amplifier Q3. When the transistor Q4 is cut off, a unijunction transistor Q5 is oscillated at a frequency determined by a capacitor C3 and resistors R11 and R12 so that a triac Q7 coupled through a power transformer PT is turned on, thereby turning on the lamp. However when the transistor Q4 is turned on the oscillation of the transistor Q5 is interrupted so that the lamp is turned off. Thereafter the microswitch Ca2 is opened, the capacitor C1 and C2 in the integrating circuit Q2 are discharged for the next exposure control.

Figure 11:
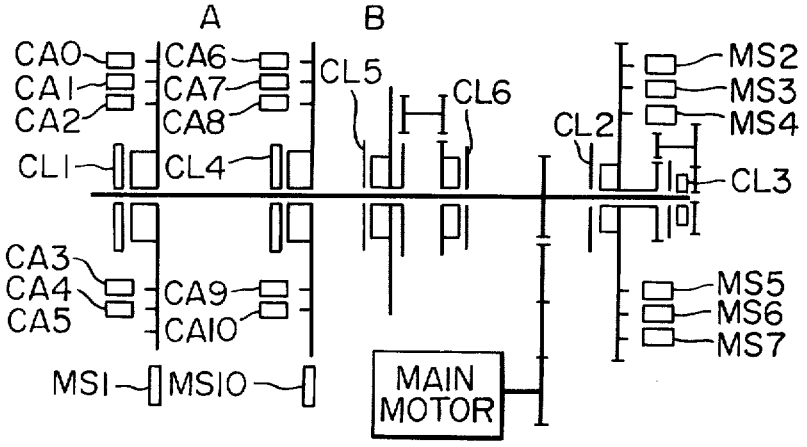
FIG. 11 is a view used for the explanation of control means.

The sequence of the steps in photocopying operation is controlled by control means shown in FIG. 11 and FIG. 12 as comprising program cams A and B, cams mounted upon the drum 12 and a group of microswitches actuable by the cams on the drum. The cams carried by the same shaft are driven by a main motor, and the program cams A and B are rotated in one direction only through clutches CL1 and CL4, respectively. The cams on the drum may be rotated in both directions through clutches CL2 and CL3. The control means further comprises cams which may rotate in both directions through clutches CL5 and CL6 and which drive the developing and rinsing chambers. FIG. 12 illustrates the time sequence of the switches actuated by the cams.

As described hereinbefore the photocopying machine in accordance with the present invention comprises an original holder 1, means 20, 21–25 for forming an electrostatic latent image, the developing means 45 and the carrier 3. A latent image is formed on the forward stroke of the carriage upon which is placed the recording medium 4, and at the end of the forward stroke the recording medium 4 is retained by the retaining means 33 and 34 and moved toward the developing means as the retaining means is rotated. After development and rinsing, the recording medium is released from the retaining means and is discharged from the photocopying machine. Since a recording medium of small size may be smoothly transported through the photocopying machine the photocopying machine of the present invention is best adapted for copying an original of samll size such as an ID card.

Furthermore when the wet developing process is employed, the developed recording medium is retained by the retaining means and dried by air flowing substantially in parallel with the surfaces of the recording medium while the recording medium is swung. Therefore the air flows so as to directly take away the developing liquid on the recording medium and the developing liquid is also separated from the recording medium as the latter swings. Therefore one air flow may accomplish two functions so that a synergistic drying effect may be obtained. Thus the drying time may be reduced to almost half of the drying time required when the recording medium is not swung at all.

The exposure control system may ensure the uniform exposure so that the uniform image quality may be ensured regardless of the degradation or aging of the lamp.

We claim:

1. An electrophotographic copying machine useful for forming an image of a small original upon a recording medium comprising:

a. means for supporting an original and means for exposing the original to light to form a light image of the original;

b. first transport means for transporting a recording medium from a loading position to a second position, said first transport means including a recording medium carrier having a cover by which the recording medium is positioned within said carrier at said loading position, and further including guide rails and drive means for moving said carrier between said loading and second positions along said guide rails;

c. processing means for forming an electrostatic latent image upon said recording medium by projecting the original light image onto the recording medium when the recording medium is between said loading and second positions;

d. means located at said second position to open said cover of said carrier when said carrier reaches said second position; and e. second transport means for removing said recording medium bearing said electrostatic latent image from said opened carrier at said second position and transporting said recording medium to a developing means for developing the electrostatic latent image into a visible image.

2. An electrophotographic copying machine as defined in claim 1 wherein said processing means includes means for charging the recording medium prior to projecting the light image of the original upon the recording medium.

3. An electrophotographic copying machine as defined in claim 1 further including means located at said second position to close said cover as said drive means returns said carrier from said second position to said loading position.

4. An electrophotographic copying machine useful for forming an image of an original upon a recording medium, said machine comprising:

a. means for supporting an original and means for exposing the supported original to light to form a light image of the original;

b. processing means for projecting the original light image onto a recording medium and for forming an electrostatic latent image thereon;

c. first transport means including a driven carrier reciprocable between a loading position, at which a recording medium is positioned on said carrier, and a second position, at which the recording medium is removed therefrom, an intermediate position being located between said loading and second positions at which the latent image is formed on the recording medium; and means for driving said carrier from said loading position past said intermediate position to said second position, said carrier having a holder to hold the recording medium within said carrier during the driving of said carrier from said loading position to said second position, said holder including first and second openable portions, said first portion being pivotally connected at one end thereof to said carrier and said second portion being pivotally connected to the opposite end of said first portion, one of said portions being openable by pivotal movement about its pivotal connection at said loading position; said transport means further including means for causing pivotal movement of the other portion about its pivotal connection at said second position to open said holder to permit removal from said carrier of the recording medium bearing the electrostatic latent image;

d. developing means for developing the electrostatic latent image on the recording medium into a visible image after removal of the medium from said carrier; and e. second transport means for removing the recording medium bearing thereon the electrostatic latent image from said carrier when said holder is opened at said second position and for transporting the removed recording medium to said developing means.

5. An electrophotograhic copying machine as defined in claim 4 wherein said first transport means further includes means for positioning the recording medium within said carrier, said positioning means including a plurality of elongated members, spring means, and cam means at said loading position, said cam means camming said elongated members to extend through said holder at said loading position and said spring means biasing said elongated members away from said holder, whereby, as said carrier moves away from said loading position, said elongated members move away from said holder.

6. An electrophotographic copying machine as defined in claim 4, wherein said second transport means includes a pair of arm members positioned adjacent to said second position, said members being relatively rotatable with respect to one another about a common axis, whereby said arm members engage the recording medium at said second position and transport it to said developing means.

7. An electrophotographic copying machine as defined in claim 4 wherein said processing means includes means for charging the recording medium prior to forming the latent image thereon.

8. An electrophotographic copying machine as defined in claim 4 wherein said first transport means further includes means for positioning the recording medium within said carrier, said positioning means comprising a positioning member and means to hold said positioning member at a first location within said carrier when said carrier is at its loading position, and to move said positioning member from said first location at least when said carrier reaches its second position.

9. An electrophotographic copying machine as defined in claim 4 wherein said original exposing means includes an exposure control means.

10. An electrophotographic copying machine as defined in claim 9 wherein said exposure control means includes a photosensitive element.

11. An electrophotographic copying machine as defined in claim 10 wherein said photosensitive element is a solar cell.

12. An electrostatic copying machine as defined in claim 4 wherein said developing means includes a developing liquid tank, a developing liquid storage tank; and a developing liquid within said developing liquid tank and said storage tank; wherein the recording medium bearing the electrostatic latent image is developed by the developing liquid.

13. An electrophotographic copying machine as defined in claim 12 further including blower means for drying the recording medium after development of the recording medium, said blower means being positioned in the path of said second transport means so that air discharged from said blower means flows substantially in parallel with the surface of the recording medium.

14. An electrophotographic copying machine as defined in claim 12 wherein said developing means further includes means for preventing the curling of the recording medium, said curl preventing means being movable to press said recording medium against the developing liquid in said developing liquid tank.

15. An electrophotographic copying machine as defined in claim 12 wherein said developing means further includes a rinsing liquid tank so disposed with respect to said developing liquid tank as to be movable into the position of said developing liquid tank when said developing liquid tank is withdrawn from said position for rinsing the developed recording medium.

16. An electrophotographic copying machine as defined in claim 15 wherein said developing liquid comprises a developer material dispersed in a carrier liquid and wherein said rinsing liquid comprises said carrier liquid.

17. An electrophotographic copying machine as defined in claim 4 wherein said first transport means further includes guide means for guiding said carrier between said loading and second positions.

18. An electrophotographic copying machine as defined in claim 4 wherein said first transport means further includes signal means located at said loading position to indicate when a recording medium is positioned within said carrier.

19. An electrophotographic copying machine as defined in claim 4 wherein said second transport means includes an arm which is rotatable about an axis at said second position, and retaining means mounted on said arm for engaging the recording medium.

20. An electrophotographic copying machine as defined in claim 19 wherein said rotatable arm is stopped at a location along the path of said second transport means so that said arm holds the developed recording medium parallel to the air flow from blower means positioned adjacent thereto.

21. An electrophotographic copying machine as defined in claim 19 wherein said retaining means comprises a pair of finger members for retaining said recording medium while being transported by said finger members.

* * * * *